US009790018B2

(12) United States Patent
Laidler

(10) Patent No.: US 9,790,018 B2
(45) Date of Patent: Oct. 17, 2017

(54) AUTOMATIC DOSING AND SPRAYING VALVE ASSEMBLY

(71) Applicant: LEAFGREEN LIMITED, Stourbridge (GB)

(72) Inventor: Keith Laidler, Stourbridge (GB)

(73) Assignee: LEAFGREEN LIMITED, Stourbridge, West Midlands (GB)

( * ) Notice: Subject to any disclaimer, the term of this patent is extended or adjusted under 35 U.S.C. 154(b) by 143 days.

(21) Appl. No.: 14/416,090

(22) PCT Filed: Jul. 23, 2013

(86) PCT No.: PCT/GB2013/000319

§ 371 (c)(1),
(2) Date: Jan. 21, 2015

(87) PCT Pub. No.: WO2014/016543

PCT Pub. Date: Jan. 30, 2014

(65) Prior Publication Data

US 2015/0191298 A1 Jul. 9, 2015

(30) Foreign Application Priority Data

Jul. 24, 2012 (GB) ..... 1213122.3
Jul. 31, 2012 (GB) ..... 1213690.9
(Continued)

(51) Int. Cl.
*B65D 83/54* (2006.01)
*B65D 83/20* (2006.01)
*B65D 83/26* (2006.01)

(52) U.S. Cl.
CPC ..... *B65D 83/54* (2013.01); *B65D 83/207* (2013.01); *B65D 83/26* (2013.01); *B65D 83/265* (2013.01)

(58) Field of Classification Search
CPC ..... B65D 83/54; B65D 83/26; B65D 83/207; B65D 83/265; G01F 11/04
(Continued)

(56) References Cited

U.S. PATENT DOCUMENTS 2,649,331 A 8/1953 Peltz et al.
3,658,209 A * 4/1972 Freeman ..... B65D 83/265 137/624.14
(Continued)

OTHER PUBLICATIONS

International Search Report from corresponding PCT Appln. No. PCT/GB2013/000319 dated May 9, 2014.

*Primary Examiner* — Paul R Durand
*Assistant Examiner* — Robert Nichols, II
(74) *Attorney, Agent, or Firm* — Grossman, Tucker, Perreault & Pfleger, PLLC

(57) ABSTRACT

A non-electrically powered automatic dosing and spraying valve assembly for a container of pressurized fluid with an outlet valve is described, wherein the valve assembly comprises a housing containing at least two chambers wherein one of those chambers is a main chamber open at one end to the contents of the container and closed at one end by a movable plunger, and another of those chambers is a dose chamber closed at one end by the movable plunger and closed at the other end by a prodder seal formed between a movable prodder and a fluid outlet opening; wherein the movable plunger is biased against movement toward the dose chamber by a main spring means and a prodder spring means, the main spring means being mounted in or adjacent to the dose chamber and the prodder spring means being connected to both the movable plunger and movable prodder, the assembly further comprises a fluid leak path between the main chamber and the dose chamber; and wherein the assembly is arranged such that, in use, one movable component of the assembly is configured to move relative to
(Continued)

another component of the assembly to temporarily expose the dose chamber to the full fluid pressure of the main chamber.

20 Claims, 4 Drawing Sheets

(30) Foreign Application Priority Data

Aug. 6, 2012 (GB) ..... 1213988.7
Aug. 29, 2012 (GB) ..... 1215309.4

(58) Field of Classification Search
USPC ..... 222/645, 649, 402.13, 402.2
See application file for complete search history.

(56) References Cited

U.S. PATENT DOCUMENTS

| | | | | |
|---|---|---|---|---|
| 5,025,962 | A * | 6/1991 | Renfro ..... | B65D 83/265 137/624.14 |
| 6,006,953 | A | 12/1999 | Newson et al. | |
| 6,588,627 | B2 * | 7/2003 | Petterson ..... | B65D 83/265 222/1 |
| 2006/0191961 | A1 | 8/2006 | Romanin | |
| 2010/0006601 | A1 | 1/2010 | De Man et al. | |

* cited by examiner

AUTOMATIC DOSING AND SPRAYING VALVE ASSEMBLY

FIELD OF THE INVENTION

The present invention relates to a non-electrically powered automatic dosing and spraying apparatus comprising a container of pressurised fluid and a valve assembly and specifically, but not exclusively, an apparatus for the spraying of air freshening composition, a sanitising composition or a pest control composition.

BACKGROUND

The use of containers of pressurised fluid, aerosol canisters, to spray fluids of various natures are commonplace in both domestic and commercial environments. Whilst the spraying of some fluids are required on "as required" basis, such as spraying a cleaning fluid on to a surface requiring cleaning, many other fluids could usefully be sprayed into the localised environment routinely to provide a constant background benefit. For instance, the routine spraying of air freshening compositions may be desirous to ensure that a room has a near constant level of fragrance for the users of the room to experience, similarly the routine spraying of pest control compositions may be desirous to ensure has a near constant level protection against pests such as airborne insects and the like.

Early efforts to provide an automatic spraying device can be seen in U.S. Pat. No. 3,968,905 published in July 1976 in which a mechanical mechanism is proposed which essentially relies on the inherent resilience of a spring disk to close an exit orifice for a period of time on exposure to the pressurised fluid of the aerosol canister. It is alleged that eventually the fluid pressure beneath the disk will become sufficient to overcome the resistance of the concave disk snapping it into a convex formation thus allowing the fluid to flow past the disk and out of the exit orifice before the inherent resilience of the disk overcomes the pressure of the fluid passing around it to snap back into a concave formation to start the cycle again. The present inventors are not aware of this device, or a device similar thereto ever being commercialised and it is assumed that this is due to the described arrangement being theoretical and that in practice such a device would never work since finding a disk having the required properties does not exist. For instance, despite the presence of the flow restrictor the disk would be exposed immediately or at least very quickly to the full pressure of the aerosol container such that should the disk be forced into the convex formation it is not understood why the disk would then snap back to the concave formation before all of the contents of the aerosol canister had bypassed the disk. Furthermore, since the pressure of the fluid in the canister would decrease over time it is not understood how a disk could be operable with the varying pressures it would be exposed to as the fluid became increasingly depleted. Although US'905 refers to preliminary performance results these value are merely theoretical based on a desired dosage size and time interval of sprays.

To address the need for automatic spraying devices numerous electrically powered device became available. One typical device is battery operated and provides a motorised actuator arm and a timer in a control unit to routinely activate the arm which contacts a valve actuator on the aerosol to depress same to open the valve and cause the pressurised fluid to be sprayed. An alternative device does not provide a valve actuator, rather the aerosol is loaded into the device and the action of loading opens the valve exposing the device to the full pressure of the fluid therein. The routine spraying is achieved by the device using a solenoid switch to open a valve in the device for a short period of time thus permitting a small quantity of the fluid to be released in accordance with a timer in a control unit.

Unfortunately there are drawbacks associated with the currently available electrically powered automatic spraying devices is that they are expensive to manufacture due to the raw materials required including the microchips in the control units, electrical wiring, motors, solenoid switches, sufficient housing material to encapsulate the aerosol canister within the interior of the device. Also from a user perspective these devices can be inconvenient in that they require batteries to operate, their size can be considered cumbersome, due to their cost they cannot be considered as disposable, the canister is typically obscured when engaged with the device.

It is an object of the present invention to provide a non-electrically powered automatic spraying device which will address such drawbacks whilst also being manufacturable rather than representing a mere theoretical solution.

SUMMARY OF INVENTION

According to a first aspect of the present invention there is provided therefore a non-electrically powered automatic dosing and spraying valve assembly for a container of pressurised fluid with an outlet valve, wherein the valve assembly comprises a housing containing at least two chambers wherein one of those chambers is a main chamber open at one end to the contents of the container and closed at one end by a movable plunger, and another of those chambers is a dose chamber closed at one end by the movable plunger and closed at the other end by a prodder seal formed between a movable prodder and a fluid outlet opening; wherein the movable plunger is biased against movement toward the dose chamber by a main spring means and a prodder spring means, the main spring means being mounted in or adjacent to the dose chamber and the prodder spring means being connected to both the movable plunger and movable prodder, the assembly further comprises a fluid leak path between the main chamber and the dose chamber; and wherein the assembly is arranged such that, in use, one movable component of the assembly is configured to move relative to another component of the assembly to temporarily expose the dose chamber to the full fluid pressure of the main chamber.

According to a second aspect of the present invention there is provided therefore a non-electrically powered automatic dosing and spraying apparatus comprising a valve assembly and a container of pressurised fluid with an outlet valve, wherein the valve assembly is connected to the container to open the outlet valve to permit the fluid to flow into the valve assembly and wherein the valve assembly comprises a housing containing at least two chambers wherein one of those chambers is a main chamber open at one end to the contents of the container and closed at one end by a movable plunger, and another of those chambers is a dose chamber closed at one end by the movable plunger and closed at the other end by a prodder seal formed between a movable prodder and a fluid outlet opening; wherein the movable plunger is biased against movement toward the dose chamber by a main spring means and a prodder spring means, the main spring means being mounted in or adjacent to the dose chamber and the prodder spring means being connected to both the movable plunger and movable prodder; the assembly further comprises a fluid leak path between the main chamber and the dose chamber; and wherein the assembly is arranged such that, in use, one movable component of the assembly is configured to move relative to another component of the assembly to temporarily expose the dose chamber to the full fluid pressure of the main chamber.

For the avoidance of doubt no limitation is imposed on the orientation in which the assembly and/or apparatus can be used by reference to the terms "above", "below", "upper" or "lower" or the like, rather these terms are merely used herein to designate a spatial relationship between the described components.

In use the movable components in the assembly preferably cycle movement between a starting position and a charging position. In the start position the movable plunger is at its uppermost position of travel when closest to a fluid inlet from the container, whilst the moveable prodder is also in its uppermost position in which the prodder does not form a seal with the fluid outlet opening. By contrast in the charging position the movable plunger initially moves to its lowest position as does the movable prodder such that the prodder creates the fluid-tight prodder seal with the fluid outlet opening. During the charging position the dose chamber will gradually fill with fluid which will begin the return stroke to the start position. During the return stroke the movable plunger will begin to move toward its uppermost position whilst the movable prodder remains engaged with the fluid outlet opening. Only when the plunger is immediately adjacent to its uppermost position is one of the movable components of the assembly moved out of contact with another component of the assembly to temporarily expose the dose chamber to the full fluid pressure of the main chamber. For a brief period of time pressurised fluid in the main chamber is then able to pass directly into the dose chamber and the brief exposure to the full container pressure achieves at least two important functions; firstly it provides a final and rapid expansion of the dose chamber which ensures that the prodder seal is broken permitting the fluid in the dose chamber to pass into the fluid outlet opening and be sprayed into the environment surrounding the assembly. Secondly, a self-cleaning function is imparted wherein impurities in the fluid could cause a blockage and/or impair the movement of one or more of the movable components and the momentary exposure to the full container pressure allows the rushing fluid to remove any particulate matter built up. The momentary exposure of the leak path and dose chamber to the full container pressure causes all of the movable components of the assembly to be in their uppermost position which is the starting position and the cycle starts again and the fluid pressure acting on the plunger moves the plunger, much like wind pushes a sail on a yacht with a small hole in it, downwards which allows the movable component of the assembly that moved out of contact with another component of the assembly to close the exposure of the dose chamber to the full fluid pressure of the main chamber, which also allows the prodder to move downwards into sealing engagement with the fluid outlet opening to re-create the prodder seal and the charging position is arrived at and the dose chamber can again begin to slowly fill with fluid.

The leak path provided between the main chamber and the dose chamber may be provided by any suitable means which facilitates the passage of fluid from the main chamber to the dose chamber, preferably the leak path is sized to facilitate a rate of fluid transfer between the chambers that is slower than the rate of fluid transfer from the container to the main chamber. The main spring means is preferably mounted coaxially with the prodder spring means.

The main spring means is provided with a spring strength that is weak enough to permit the moveable plunger to travel down the main chamber from a start position to a charging position in which the prodder seal between the moveable prodder and fluid outlet opening is made when exposed to the fluid pressure from the container, whilst also being strong enough to act with the fluid pressure in the dose chamber to return the moveable plunger back to the start position. Preferably the main spring means is provided in the valve assembly to provide resistive pushing forces only. The main spring means may be a helical spring and is preferably made from any material that is resistant to corrosion. When the main spring means is provided by a helical spring the main spring is sized to surround at least a portion of the prodder spring means.

The prodder spring means is preferably provided of a size and strength such that when the moveable plunger is adjacent to the start position the prodder spring means is resistant to any further stretching such that further movement of the plunger toward the start position will cause the timer pin to urge the ball out of contact with the ball seat and thus momentarily expose the dose chamber to the full fluid pressure of the container and cause the prodder spring to pull the prodder away from the fluid outlet opening to break the prodder seal. Preferably the prodder spring means is provided in the valve assembly to provide both resistive pushing and pulling forces depending upon which part of the cycle of movement the movable components are in. The prodder spring means may be a helical spring and is preferably made from any material that is resistant to corrosion.

The movable plunger is sized to move within the main chamber and is preferably provided with sealing means to prevent the free movement of fluid between the main chamber and the dose chamber. The sealing means could be an integral part of the plunger but are preferably provided by at least one separate component that is made from a material resistant to corrosion or degradation by the fluid. More than one sealing means could be provided spaced apart from each other to provide several points of sealing contact with the main chamber and any other chamber therewithin to prevent free movement of fluid between the main chamber and the dose chamber other than via the leak path.

The movable prodder is sized to move within the dose chamber and is preferably provided with a portion of its lowest end adjacent the fluid outlet opening defining an at least partially tapered cylinder profile to facilitate an ease of engagement and sealing with the fluid outlet opening in the charging position. The fluid outlet opening is preferably cylindrical and sized to form a convenient interference fit with the prodder. Preferably the fluid outlet opening is formed from a material with at least some flexibility to improve the resultant prodder seal.

Most preferably a fluid inlet from the container into the main chamber of the assembly is at the substantially uppermost part of the main chamber and the leak path to the dose chamber is at the substantially lowermost part of the main chamber. Further preferably the leak path from the main chamber to the dose chamber is located at the substantially uppermost part of the dose chamber and the fluid outlet opening is at the substantially lowest part of the dose chamber. Particularly preferably the apparatus has a preferred operating orientation wherein the apparatus is orientation such that the fluid inlet from the container into the main chamber of the assembly is at the substantially uppermost part of the main chamber and the leak path to the dose chamber is at the substantially lowermost part of the main chamber and the leak path is located at the substantially uppermost part of the dose chamber and the fluid outlet opening is at the substantially lowest part of the dose chamber. This preferred operating orientation ensures that if there is any separation of the pressurised fluid into liquid and gas the liquid will accumulate below the gas adjacent the leak path or fluid outlet opening respectively such that the gas moving through the leak path and fluid outlet opening will minimise or eradicate prolonged accumulation of liquid in either chamber.

Preferably the main chamber and the dose chamber are substantially cylindrical.

The main chamber and dose chamber may be provided with substantially similar diameters. The main chamber may be positioned directly above dose chamber.

Alternatively the dose chamber may be provided with a reduced diameter relative to the diameter of the main chamber. The main chamber may be located above and at least partially surrounding the dose chamber wherein dose chamber walls are provided within the main chamber. Where the dose size to be sprayed is to be of a small quantity, in the order of ≤50 mg, then preferably the diameter of the dose chamber walls have a diameter of ≤5 mm.

The uppermost part of the main chamber may be closed by a moveable threaded top which can be screwed down to close or at least partially close fluid flow into the main chamber and/or to restrict movement of the plunger. A moveable threaded top may provide on/off functionality and/or a timing functionality.

A particulate filter may be provided in a fluid flow path between the container and the main chamber to reduce or prevent the passage of particulate matter into the main chamber and further into the valve assembly thus reducing the likelihood of the device tending toward blockage and/or failure.

The fluid outlet opening is connected via an outlet conduit to a nozzle which will spray the fluid into the environment surrounding the valve assembly. A swirl chamber of the like may be located upstream or integral with the nozzle to improve the spray properties of the sprayed fluid.

According to a third aspect of the present invention there is provided therefore a non-electrically powered method of dosing and spraying a pressurised fluid wherein a container of pressurised fluid with an outlet valve is connected to a valve assembly such that the outlet valve is opened and the valve assembly comprises a housing containing at least two chambers wherein one of those chambers is a main chamber open at one end to the contents of the container and closed at one end by a movable plunger, and another of those chambers is a dose chamber closed at one end by the movable plunger and closed at the other end by a prodder seal formed between a movable prodder and a fluid outlet opening; wherein the movable plunger is biased against movement toward the dose chamber by a main spring means and a prodder spring means, the main spring means being mounted in or adjacent to the dose chamber and the prodder spring means being connected to both the movable plunger and movable prodder, the assembly further comprises a fluid leak path between the main chamber and the dose chamber; and wherein the assembly is arranged such that, in use, one movable component of the assembly is configured to move relative to another component of the assembly to temporarily expose the dose chamber to the full fluid pressure of the main chamber; the steps comprising activating the valve assembly to permit the fluid to move the movable components of the assembly through from a start position to a charging position, wherein in the start position the movable plunger is at its uppermost position of travel when closest to a fluid inlet from the container, whilst the moveable prodder is also in its uppermost position in which the prodder does not form a seal with the fluid outlet opening and wherein in the charging position the movable plunger and movable prodder are at their lowest positions and the movable prodder forms the prodder seal with the fluid outlet opening.

The method further comprises the steps of allowing the assembly to cycle through from the charging position back to the starting position before repeating the cycle, wherein at the start of the charging position the dose chamber begins to fill with fluid which initiates the return stroke to the starting position, wherein during the return stroke the movable plunger moves toward its uppermost position whilst the movable prodder remains engaged with the fluid outlet opening until the plunger is immediately adjacent to its uppermost position when one of the movable components of the assembly moves out of contact with another component of the assembly to temporarily expose the dose chamber to the full fluid pressure of the main chamber to cause the prodder to be pulled out of sealing engagement with the fluid outlet opening and permit the final travel of the plunger to the starting position and simultaneously therewith the fluid in the dose chamber is permitted to pass into the fluid outlet opening and spray into the environment surrounding to assembly.

The method may further comprise deactivating the assembly to arrest the movement of the movable components and thus cease further spraying of fluid.

The apparatus may be useful in numerous fields including but not limited to room cooling and humidifying, watering of plants, industrial applications, cleaning, biocides, delivering a jet of liquor.

According to a fourth aspect of the present invention there is provided therefore a non-electrically powered automatic dosing and spraying valve assembly for a container of pressurised fluid with an outlet valve, wherein the valve assembly comprises a housing containing at least two chambers wherein one of those chambers is a main chamber open at one end to the contents of the container and closed at one end by a movable plunger with plunger sealing means, and another of those chambers is a dose chamber closed at one end by the movable plunger and closed at the other end by a prodder seal formed between a movable prodder and a fluid outlet opening; wherein the movable plunger is biased against movement toward the dose chamber by a main spring means and a prodder spring means, the main spring means being mounted in or adjacent to the dose chamber and the prodder spring means being connected to both the movable plunger and movable prodder; and wherein a fluid leak path between the main chamber and the dose chamber is provided, and wherein at least one of the main chamber and/or dose chamber is provided with one or more at least a partial grooves therein arranged to be located adjacent said plunger sealing means when the plunger is at or adjacent to its uppermost position remote from the fluid outlet opening.

According to a fifth aspect of the present invention there is provided therefore a non-electrically powered automatic dosing and spraying apparatus comprising a valve assembly and a container of pressurised fluid with an outlet valve, wherein the valve assembly is connected to the container to open the outlet valve to permit the fluid to flow into the valve assembly and wherein the valve assembly comprises a housing containing at least two chambers wherein one of those chambers is a main chamber open at one end to the contents of the container and closed at one end by a movable plunger with plunger sealing means, and another of those chambers is a dose chamber closed at one end by the movable plunger and closed at the other end by a prodder seal formed between a movable prodder and a fluid outlet opening; wherein the movable plunger is biased against movement toward the dose chamber by a main spring means and a prodder spring means, the main spring means being mounted in or adjacent to the dose chamber and the prodder spring means being connected to both the movable plunger and movable prodder; and wherein a fluid leak path between the main chamber and the dose chamber is provided, and wherein at least one of the main chamber and/or dose chamber is provided with one or more at least a partial grooves therein arranged to be located adjacent said plunger sealing means when the plunger is at or adjacent to its uppermost position remote from the fluid outlet opening.

For the avoidance of doubt no limitation is imposed on the orientation in which the assembly and/or apparatus can be used by reference to the terms "above", "below", "upper" or "lower" or the like, rather these terms are merely used herein to designate a spatial relationship between the described components.

The leak path may be provided by a substantially centralised hole in the plunger that travels the entire length of the plunger. Alternatively the leak path may be provided by one or more vertically elongate score lines extending along an interior surface of the main chamber into the interior surface of the dose chamber. The at least partial groove is bigger in volume that the score line(s). The at least partial groove may extend circumferentially and/or vertically. The at least partial groove may be superimposed on one or more of the score lines or may be spaced apart therefrom.

In use the movable components in the assembly preferably cycle movement between a starting position and a charging position. In the start position the movable plunger is at its uppermost position of travel when closest to a fluid inlet from the container, whilst the moveable prodder is also in its uppermost position in which the prodder does not form a seal with the fluid outlet opening. By contrast in the charging position the movable plunger initially moves to its lowest position as does the movable prodder such that the prodder creates the fluid-tight prodder seal with the fluid outlet opening. During the charging position the dose chamber will gradually fill with fluid which will begin the return stroke to the start position. During the return stroke the movable plunger will begin to move toward its uppermost position whilst the movable prodder remains engaged with the fluid outlet opening. When the plunger sealing means are immediately adjacent to the at least partial groove in the main chamber and/or dose chamber and the fluid is able to escape from the main chamber into the dose chamber via said groove thus very briefly permitting the dose chamber and/or the leak path where the leak path is a superimposed score line, to be exposed to the full fluid pressure of the container. The brief exposure to the full container pressure achieves at least two important functions; firstly it provides a final and rapid expansion of the dose chamber which ensures that the prodder seal is broken permitting the fluid in the dose chamber to pass into the fluid outlet opening and be sprayed into the environment surrounding the assembly. Secondly, if the leak path is a superimposed score line the brief exposure momentarily exposes said leak path to the full can pressure which imparts a self-cleaning function. The leak path is preferably a fluid flow restrictor, as discussed more later, to slow the rate at which the dose chamber fills with fluid during the charging position, however, impurities in the fluid could cause a blockage in the leak path, so the momentary exposure to the full container pressure allows the rushing fluid to remove any particulate matter built up in the leak path, i.e. clean the leak path. The momentary exposure of the leak path and dose chamber to the full container pressure causes all of the movable components of the assembly to be in their uppermost position which is the starting position and the cycle starts again and the fluid pressure acting on the plunger moves the plunger, much like wind pushes a sail on a yacht with a small hole in it, downwards which allows the prodder to move downwards into sealing engagement with the fluid outlet opening to re-create the prodder seal and the charging position is arrived at and the dose chamber can again begin to slowly fill with fluid.

The main spring means is preferably mounted coaxially with the prodder spring means. The main spring means is provided with a spring strength that is weak enough to permit the moveable plunger to travel down the main chamber from a start position to a charging position in which the prodder seal between the moveable prodder and fluid outlet opening is made when exposed to the fluid pressure from the container, whilst also being strong enough to act with the fluid pressure in the dose chamber to return the moveable plunger back to the start position. Preferably the main spring means is provided in the valve assembly to provide resistive pushing forces only. The main spring means may be a helical spring and is preferably made from any material that is resistant to corrosion. When the main spring means is provided by a helical spring the main spring is sized to surround at least a portion of the prodder spring means.

The prodder spring means is preferably provided of a size and strength such that when the moveable plunger is adjacent to the start position the prodder spring means is resistant to any further stretching such that further movement of the plunger toward the start position will cause the timer pin to urge the ball out of contact with the ball seat and thus momentarily expose the dose chamber to the full fluid pressure of the container and cause the prodder spring to pull the prodder away from the fluid outlet opening to break the prodder seal. Preferably the prodder spring means is provided in the valve assembly to provide both resistive pushing and pulling forces depending upon which part of the cycle of movement the movable components are in. The prodder spring means may be a helical spring and is preferably made from any material that is resistant to corrosion.

The movable plunger is sized to move within the main chamber and is preferably provided with sealing means to prevent the free movement of fluid between the main chamber and the dose chamber. The sealing means could be an integral part of the plunger but are preferably provided by at least one separate component that is made from a material resistant to corrosion or degradation by the fluid. More than one sealing means could be provided spaced apart from each other to provide several points of sealing contact with the main chamber and any other chamber therewithin to prevent free movement of fluid between the main chamber and the dose chamber other than via the leak path.

The movable prodder is sized to move within the dose chamber and is preferably provided with a portion of its lowest end adjacent the fluid outlet opening defining an at least partially tapered cylinder profile to facilitate an ease of engagement and sealing with the fluid outlet opening in the charging position. The fluid outlet opening is preferably cylindrical and sized to form a convenient interference fit with the prodder. Preferably the fluid outlet opening is formed from a material with at least some flexibility to improve the resultant prodder seal.

Most preferably a fluid inlet from the container into the main chamber of the assembly is at the substantially uppermost part of the main chamber and the leak path to the dose chamber is at the substantially lowermost part of the main chamber. Further preferably the leak path from the main chamber to the dose chamber is located at the substantially uppermost part of the dose chamber and the fluid outlet opening is at the substantially lowest part of the dose chamber. Particularly preferably the apparatus has a preferred operating orientation wherein the apparatus is orientation such that the fluid inlet from the container into the main chamber of the assembly is at the substantially uppermost part of the main chamber and the leak path to the dose chamber is at the substantially lowermost part of the main chamber and the leak path is located at the substantially uppermost part of the dose chamber and the fluid outlet opening is at the substantially lowest part of the dose chamber. This preferred operating orientation ensures that if there is any separation of the pressurised fluid into liquid and gas the liquid will accumulate below the gas adjacent the leak path or fluid outlet opening respectively such that the gas moving through the leak path and fluid outlet opening will minimise or eradicate prolonged accumulation of liquid.

Most preferably a fluid inlet from the container into the main chamber of the assembly is at the substantially uppermost part of the main chamber and the leak path to the dose chamber is at the substantially lowermost part of the main chamber. Further preferably the leak path from the main chamber to the dose chamber is located at the substantially uppermost part of the dose chamber and the fluid outlet opening is at the substantially lowest part of the dose chamber. Particularly preferably the apparatus has a preferred operating orientation wherein the apparatus is orientation such that the fluid inlet from the container into the main chamber of the assembly is at the substantially uppermost part of the main chamber and the leak path to the dose chamber is at the substantially lowermost part of the main chamber and the leak path is located at the substantially uppermost part of the dose chamber and the fluid outlet opening is at the substantially lowest part of the dose chamber. This preferred operating orientation ensures that if there is any separation of the pressurised fluid into liquid and gas the liquid will accumulate below the gas adjacent the leak path or fluid outlet opening respectively such that the gas moving through the leak path and fluid outlet opening will minimise or eradicate prolonged accumulation of liquid in either chamber.

Preferably the main chamber and the dose chamber are substantially cylindrical.

The main chamber and dose chamber may be provided with substantially similar diameters. The main chamber may be positioned directly above dose chamber.

Alternatively the dose chamber may be provided with a reduced diameter relative to the diameter of the main chamber. The main chamber may be located above and at least partially surrounding the dose chamber wherein dose chamber walls are provided within the main chamber. Where the dose size to be sprayed is to be of a small quantity, in the order of ≤50 mg, then preferably the diameter of the dose chamber walls have a diameter of ≤5 mm.

The uppermost part of the main chamber may be closed by a moveable threaded top which can be screwed down to close or at least partially close fluid flow into the main chamber and/or to restrict movement of the plunger. A moveable threaded top may provide on/off functionality and/or a timing functionality.

A particulate filter may be provided in a fluid flow path between the container and the main chamber to reduce or prevent the passage of particulate matter into the main chamber and further into the valve assembly thus reducing the likelihood of the device tending toward blockage and/or failure.

The fluid outlet opening is connected via an outlet conduit to a nozzle which will spray the fluid into the environment surrounding the valve assembly. A swirl chamber of the like may be located upstream or integral with the nozzle to improve the spray properties of the sprayed fluid.

According to a sixth aspect of the present invention there is provided therefore a non-electrically powered method of dosing and spraying a pressurised fluid wherein a container of pressurised fluid with an outlet valve is connected to a valve assembly such that the outlet valve is opened and the valve assembly comprises a housing containing at least two chambers wherein one of those chambers is a main chamber open at one end to the contents of the container and closed at one end by a movable plunger with plunger sealing means, and another of those chambers is a dose chamber closed at one end by the movable plunger and closed at the other end by a prodder seal formed between a movable prodder and a fluid outlet opening; wherein the movable plunger is biased against movement toward the dose chamber by a main spring means and a prodder spring means, the main spring means being mounted in or adjacent to the dose chamber and the prodder spring means being connected to both the movable plunger and movable prodder; and wherein a fluid leak path between the main chamber and the dose chamber is provided, and wherein at least one of the main chamber and/or dose chamber is provided with one or more at least a partial grooves therein arranged to be located adjacent said plunger sealing means when the plunger is at or adjacent to its uppermost position remote from the fluid outlet opening, the steps comprising activating the valve assembly to permit the fluid to move the movable components of the assembly through from a start position to a charging position, wherein in the start position the movable plunger is at its uppermost position of travel when closest to a fluid inlet from the container, whilst the moveable prodder is also in its uppermost position in which the prodder does not form a seal with the fluid outlet opening and wherein in the charging position the movable plunger and movable prodder are at their lowest positions and the movable prodder forms the prodder seal with the fluid outlet opening.

The method further comprises the steps of allowing the assembly to cycle through from the charging position back to the starting position before repeating the cycle, wherein at the start of the charging position the dose chamber begins to fill with fluid which initiates the return stroke to the starting position, wherein during the return stroke the movable plunger moves toward its uppermost position whilst the movable prodder remains engaged with the fluid outlet opening until the plunger is immediately adjacent to the at least partial groove in the main chamber allowing the fluid to escape from the main chamber into the dose chamber via said groove thus permitting the dose chamber and/or the leak path where the leak path is a superimposed score line, to be exposed to the full fluid pressure of the container to cause the prodder to be pulled out of sealing engagement with the fluid outlet opening and permit the final travel of the plunger to the starting position and simultaneously therewith the fluid in the dose chamber is permitted to pass into the fluid outlet opening and spray into the environment surrounding to assembly.

The method may further comprise deactivating the assembly to arrest the movement of the movable components and thus cease further spraying of fluid.

The apparatus may be useful in numerous fields including but not limited to room cooling and humidifying, watering of plants, industrial applications, cleaning, biocides, delivering a jet of liquor.

According to a seventh aspect of the present invention there is provided therefore a non-electrically powered automatic dosing and spraying valve assembly for a container of pressurised fluid with an outlet valve, wherein the valve assembly comprises a housing containing at least two chambers wherein one of those chambers is a main chamber open at one end to the contents of the container and closed at one end by a movable plunger, and another of those chambers is a dose chamber closed at one end by the movable plunger and closed at the other end by a prodder seal formed between a movable prodder and a fluid outlet opening; wherein the movable plunger is biased against movement toward the dose chamber by a main spring means and a prodder spring means, the main spring means being mounted in or adjacent to the dose chamber and the prodder spring means being connected to both the movable plunger and movable prodder; and wherein the movable plunger is provided with a hole the assembly further comprises a fluid leak path between the main chamber and the dose chamber provided by at least one hole which travels the length of the plunger between the main chamber and the dose chamber, the entrance to said at least one hole is surrounded by a ball seat and a ball is provided in the main chamber sized to partially or almost form a fluid seal against said ball seat, and wherein the main chamber is provided with a timer pin located off-centre relative to the ball and arranged to contact the ball when the plunger is at or adjacent to its uppermost position remote from the fluid outlet opening.

According to an eighth aspect of the present invention there is provided therefore a non-electrically powered automatic dosing and spraying apparatus comprising a valve assembly and a container of pressurised fluid with an outlet valve, wherein the valve assembly is connected to the container to open the outlet valve to permit the fluid to flow into the valve assembly and wherein the valve assembly comprises a housing containing at least two chambers wherein one of those chambers is a main chamber open at one end to the contents of the container and closed at one end by a movable plunger, and another of those chambers is a dose chamber closed at one end by the movable plunger and closed at the other end by a prodder seal formed between a movable prodder and a fluid outlet opening; wherein the movable plunger is biased against movement toward the dose chamber by a main spring means and a prodder spring means, the main spring means being mounted in or adjacent to the dose chamber and the prodder spring means being connected to both the movable plunger and movable prodder; and wherein the movable plunger is provided with a hole the assembly further comprises a fluid leak path between the main chamber and the dose chamber provided by at least one hole which travels the length of the plunger between the main chamber and the dose chamber, the entrance to said at least one hole is surrounded by a ball seat and a ball is provided in the main chamber sized to partially or almost form a fluid seal against said ball seat, and wherein the main chamber is provided with a timer pin located off-centre relative to the ball and arranged to contact the ball when the plunger is at or adjacent its uppermost position remote from the fluid outlet opening.

For the avoidance of doubt no limitation is imposed on the orientation in which the assembly and/or apparatus can be used by reference to the terms "above", "below", "upper" or "lower" or the like, rather these terms are merely used herein to designate a spatial relationship between the described components.

In use the movable components in the assembly preferably cycle movement between a starting position and a charging position. In the start position the movable plunger is at its uppermost position of travel when closest to a fluid inlet from the container, whilst the moveable prodder is also in its uppermost position in which the prodder does not form a seal with the fluid outlet opening. By contrast in the charging position the movable plunger initially moves to its lowest position as does the movable prodder such that the prodder creates the fluid-tight prodder seal with the fluid outlet opening. During the charging position the dose chamber will gradually fill with fluid which will begin the return stroke to the start position. During the return stroke the movable plunger will begin to move toward its uppermost position whilst the movable prodder remains engaged with the fluid outlet opening. When the plunger is immediately adjacent to its uppermost position the timer pin makes contact with an off-centre part of the ball which urges the ball out of partial or almost sealing engagement with the ball seat and very briefly permit the dose chamber and/or the leak path to be exposed to the full fluid pressure of the container. The brief exposure to the full container pressure achieves at least two important functions; firstly it provides a final and rapid expansion of the dose chamber which ensures that the prodder seal is broken permitting the fluid in the dose chamber to pass into the fluid outlet opening and be sprayed into the environment surrounding the assembly. Secondly, the brief exposure momentarily exposes the leak path to the full can pressure which imparts a self-cleaning function. The leak path is preferably a fluid flow restrictor, as discussed more later, to slow the rate at which the dose chamber fills with fluid during the charging position, however, impurities in the fluid could cause a blockage in the leak path, so the momentary exposure to the full container pressure allows the rushing fluid to remove any particulate matter built up in the leak path, i.e. clean the leak path. The momentary exposure of the leak path and dose chamber to the full container pressure causes all of the movable components of the assembly to be in their uppermost position which is the starting position and the cycle starts again and the fluid pressure acting on the plunger moves the plunger, much like wind pushes a sail on a yacht with a small hole in it, downwards which allows the ball to move away from the timer pin and again almost seal or partially seal against the ball seat and allows the prodder to move downwards into sealing engagement with the fluid outlet opening to re-create the prodder seal and the charging position is arrived at and the dose chamber can again begin to slowly fill with fluid.

The main spring means is preferably mounted coaxially with the prodder spring means. The main spring means is provided with a spring strength that is weak enough to permit the moveable plunger to travel down the main chamber from a start position to a charging position in which the prodder seal between the moveable prodder and fluid outlet opening is made when exposed to the fluid pressure from the container, whilst also being strong enough to act with the fluid pressure in the dose chamber to return the moveable plunger back to the start position. Preferably the main spring means is provided in the valve assembly to provide resistive pushing forces only. The main spring means may be a helical spring and is preferably made from any material that is resistant to corrosion. When the main spring means is provided by a helical spring the main spring is sized to surround at least a portion of the prodder spring means.

The prodder spring means is preferably provided of a size and strength such that when the moveable plunger is adjacent to the start position the prodder spring means is resistant to any further stretching such that further movement of the plunger toward the start position will cause the timer pin to urge the ball out of contact with the ball seat and thus momentarily expose the dose chamber to the full fluid pressure of the container and cause the prodder spring to pull the prodder away from the fluid outlet opening to break the prodder seal. Preferably the prodder spring means is provided in the valve assembly to provide both resistive pushing and pulling forces depending upon which part of the cycle of movement the movable components are in. The prodder spring means may be a helical spring and is preferably made from any material that is resistant to corrosion.

A ball spring means may be provided between the ball and an upper surface of the main chamber to assist in ensuring the almost or partial seal between the ball and the ball seat. The ball spring may be advantageous in that is ensures a rapid and accurate location of the ball against the ball seat once contact between the timer pin and the ball is broken. The ball spring means may be provided by a helical spring that is preferably resistant to corrosion.

A ball seat may be formed in a conical shape to improve the ease with which the ball and ball seat form the almost or partial seal therebetween. Alternatively the ball seat may be formed with a partial spherical portion corresponding in curvature to the curvature of the ball to improve the ease with which the ball and ball seat form the almost or partial seal therebetween. The ball seat may be formed from a material with at least some flexibility to improve the resultant partial seal. The top surface of the plunger may be conical with the ball seat in the centre thereof.

The timer pin may be a projection which extends from an upper surface of the main chamber. Alternatively the timer pin may be a bulbous protrusion that extends from one side of the upper surface of a portion of the main chamber.

The movable plunger is sized to move within the main chamber and is preferably provided with sealing means to prevent the free movement of fluid between the main chamber and the dose chamber. The sealing means could be an integral part of the plunger but are preferably provided by at least one separate component that is made from a material resistant to corrosion or degradation by the fluid. More than one sealing means could be provided spaced apart from each other to provide several points of sealing contact with the main chamber and any other chamber therewithin to prevent free movement of fluid between the main chamber and the dose chamber other than via the leak path.

The movable prodder is sized to move within the dose chamber and is preferably provided with a portion of its lowest end adjacent the fluid outlet opening defining an at least partially tapered cylinder profile to facilitate an ease of engagement and sealing with the fluid outlet opening in the charging position. The fluid outlet opening is preferably cylindrical and sized to form a convenient interference fit with the prodder. Preferably the fluid outlet opening is formed from a material with at least some flexibility to improve the resultant prodder seal.

Preferably the leak path is sized to facilitate a rate of fluid transfer between the chambers that is slower than the rate of fluid transfer from the container to the main chamber.

Particularly preferably the almost or partial seal between the ball and ball seat restricts the fluid flow into the leak path such that it takes in the order of 5-20 minutes for the plunger and prodder to move from the starting position through the charging position and back to the starting position.

Most preferably a fluid inlet from the container into the main chamber of the assembly is at the substantially uppermost part of the main chamber and the leak path to the dose chamber is at the substantially lowermost part of the main chamber. Further preferably the leak path from the main chamber to the dose chamber is located at the substantially uppermost part of the dose chamber and the fluid outlet opening is at the substantially lowest part of the dose chamber. Particularly preferably the apparatus has a preferred operating orientation wherein the apparatus is orientation such that the fluid inlet from the container into the main chamber of the assembly is at the substantially uppermost part of the main chamber and the leak path to the dose chamber is at the substantially lowermost part of the main chamber and the leak path is located at the substantially uppermost part of the dose chamber and the fluid outlet opening is at the substantially lowest part of the dose chamber. This preferred operating orientation ensures that if there is any separation of the pressurised fluid into liquid and gas the liquid will accumulate below the gas adjacent the leak path or fluid outlet opening respectively such that the gas moving through the leak path and fluid outlet opening will minimise or eradicate prolonged accumulation of liquid in either chamber.

Preferably the main chamber and the dose chamber are substantially cylindrical.

The main chamber and dose chamber may be provided with substantially similar diameters. The main chamber may be positioned directly above dose chamber.

Alternatively the dose chamber may be provided with a reduced diameter relative to the diameter of the main chamber. The main chamber may be located above and at least partially surrounding the dose chamber wherein dose chamber walls are provided within the main chamber. Where the dose size to be sprayed is to be of a small quantity, in the order of ≤50 mg, then preferably the diameter of the dose chamber walls have a diameter of ≤5 mm.

The uppermost part of the main chamber may be closed by a moveable threaded top which can be screwed down to close or at least partially close fluid flow into the main chamber and/or to restrict movement of the plunger. A moveable threaded top may provide on/off functionality and/or a timing functionality.

A particulate filter may be provided in a fluid flow path between the container and the main chamber to reduce or prevent the passage of particulate matter into the main chamber and further into the valve assembly thus reducing the likelihood of the device tending toward blockage and/or failure.

The fluid outlet opening is connected via an outlet conduit to a nozzle which will spray the fluid into the environment surrounding the valve assembly. A swirl chamber of the like may be located upstream or integral with the nozzle to improve the spray properties of the sprayed fluid.

According to a ninth aspect of the present invention there is provided therefore a non-electrically powered method of dosing and spraying a pressurised fluid wherein a container of pressurised fluid with an outlet valve is connected to a valve assembly such that the outlet valve is opened and the valve assembly comprises a housing containing at least two chambers wherein one of those chambers is a main chamber open at one end to the contents of the container and closed at one end by a movable plunger, and another of those chambers is a dose chamber closed at one end by the movable plunger and closed at the other end by a prodder seal formed between a movable prodder and a fluid outlet opening; wherein the movable plunger is biased against movement toward the dose chamber by a main spring means and a prodder spring means, the main spring means being mounted in or adjacent to the dose chamber and the prodder spring means being connected to both the movable plunger and movable prodder; and wherein the movable plunger is provided with a hole the assembly further comprises a fluid leak path between the main chamber and the dose chamber provided by at least one hole which travels the length of the plunger between the main chamber and the dose chamber, the entrance to said at least one hole is surrounded by a ball seat and a ball is provided in the main chamber sized to partially or almost form a fluid seal against said ball seat, and wherein the main chamber is provided with a timer pin located off-centre relative to the ball and arranged to contact the ball when the plunger is at or adjacent its uppermost position remote from the fluid outlet opening, the steps comprising activating the valve assembly to permit the fluid to move the movable components of the assembly through from a start position to a charging position, wherein in the start position the movable plunger is at its uppermost position of travel when closest to a fluid inlet from the container, whilst the moveable prodder is also in its uppermost position in which the prodder does not form a seal with the fluid outlet opening and wherein in the charging position the movable plunger and movable prodder are at their lowest positions and the movable prodder forms the prodder seal with the fluid outlet opening.

The method further comprises the steps of allowing the assembly to cycle through from the charging position back to the starting position before repeating the cycle, wherein at the start of the charging position the dose chamber begins to fill with fluid which initiates the return stroke to the starting position, wherein during the return stroke the movable plunger moves toward its uppermost position whilst the movable prodder remains engaged with the fluid outlet opening until the plunger is immediately adjacent to its uppermost position whereupon the timer pin contacts an off-centre part of the ball to urge the ball out of contact with the ball seat and permit the dose chamber and/or the leak path to be exposed to the full fluid pressure of the container to cause the prodder to be pulled out of sealing engagement with the fluid outlet opening and permit the final travel of the plunger to the starting position and simultaneously therewith the fluid in the dose chamber is permitted to pass into the fluid outlet opening and spray into the environment surrounding to assembly.

The method may further comprise deactivating the assembly to arrest the movement of the movable components and thus cease further spraying of fluid.

The apparatus may be useful in numerous fields including but not limited to room cooling and humidifying, watering of plants, industrial applications, cleaning, biocides, delivering a jet of liquor.

According to a tenth aspect of the present invention there is provided therefore a non-electrically powered automatic dosing and spraying valve assembly for a container of pressurised fluid with an outlet valve, wherein the valve assembly comprises a housing containing at least two chambers wherein one of those chambers is a main chamber open at one end to the contents of the container and closed at one end by a movable plunger, and another of those chambers is a dose chamber closed at one end by the movable plunger and closed at the other end by a prodder seal formed between a movable prodder and a fluid outlet opening; wherein the movable plunger is biased against movement toward the dose chamber by a main spring means and wherein both the movable plunger and movable prodder are connected, the assembly further comprises a fluid leak path between the main chamber and the dose chamber; and wherein the assembly is arranged such that, in use, one movable component of the assembly is configured to move relative to another component of the assembly to temporarily expose the dose chamber to the full fluid pressure of the main chamber.

According to an eleventh aspect of the present invention there is provided therefore a non-electrically powered automatic dosing and spraying apparatus comprising a valve assembly and a container of pressurised fluid with an outlet valve, wherein the valve assembly is connected to the container to open the outlet valve to permit the fluid to flow into the valve assembly and wherein the valve assembly comprises a housing containing at least two chambers wherein one of those chambers is a main chamber open at one end to the contents of the container and closed at one end by a movable plunger, and another of those chambers is a dose chamber closed at one end by the movable plunger and closed at the other end by a prodder seal formed between a movable prodder and a fluid outlet opening; wherein the movable plunger is biased against movement toward the dose chamber by a main spring means and wherein both the movable plunger and movable prodder are connected; the assembly further comprises a fluid leak path between the main chamber and the dose chamber; and wherein the assembly is arranged such that, in use, one movable component of the assembly is configured to move relative to another component of the assembly to temporarily expose the dose chamber to the full fluid pressure of the main chamber.

BRIEF DESCRIPTION OF THE DRAWINGS

Embodiments of the invention will now be described, by way of example only, with reference to the following drawings in which.

DESCRIPTION OF AN EMBODIMENT

Figure 1:
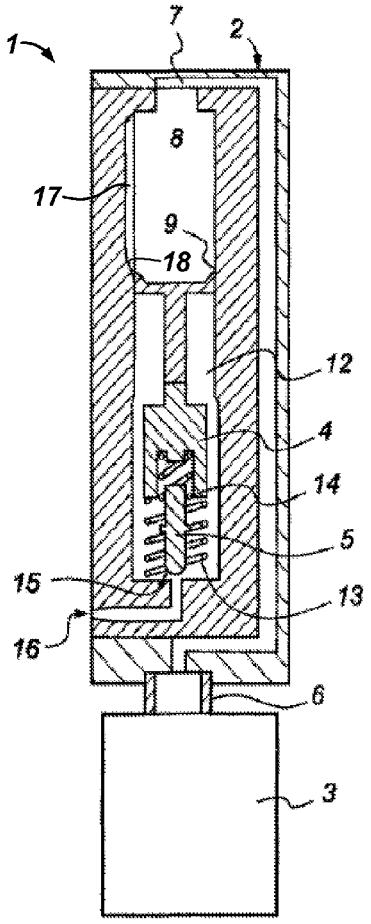
FIG. 1 illustrates a sectioned side view of an apparatus according to aspects 1-6 of the present invention in a start position.
Figure 2:
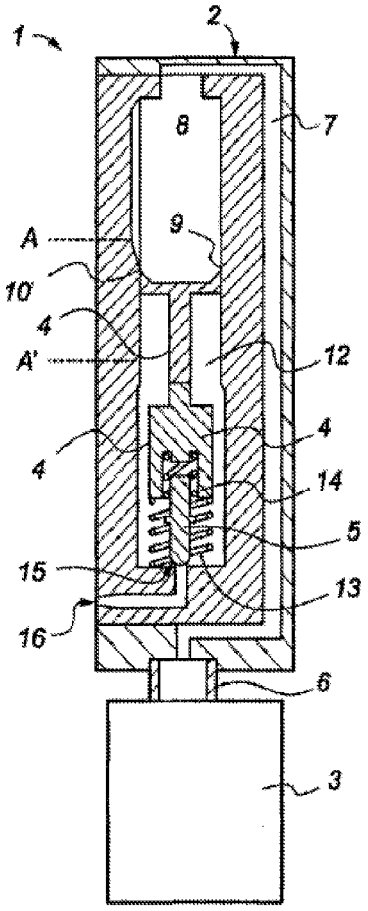
FIG. 2 illustrates a sectioned side view of an apparatus according to aspects 1-6 of the present invention in a charging position.

Referring to both FIGS. 1&2, a non-electrically powered automatic dosing and spraying apparatus 1 is shown which comprises a valve assembly 2 and a container of pressurised fluid 3. The container of fluid 3 may be a standard aerosol canister with an outlet valve 6, wherein the valve assembly 2 is connected to the container 3 to open the outlet valve 6 to permit the fluid to flow into the valve assembly 2. The fluid flows through a fluid inlet 7 and into a main chamber 8 where the fluid meets a movable plunger 4 which is sealed via sealing means 9 against the inner walls of the main chamber 8. The plunger 4 is provided with a leak path provided by a centralised hole 10 (not shown) that travels the entire length of the plunger 4. The hole 10 may be covered by a restriction means (not shown) in the form of a flat washer or the like which almost seals the hole 10 against fluid flow into same. FIGS. 1&2 show a further leak path in the form of score line 10' that travel between lines A and A'.

The leak paths provided by hole 10, and score line 10', lead to dose chamber 12 located directly below the main chamber 8 and is shown here with both chambers 8&12 having a substantially identical diameter and are formed from a singular chamber which is separated into the main chamber 8 and the dose chamber 12 solely by the contact point of the sealing means 9 against the walls of said singular chamber.

In the dose chamber 12 there is housed a movable prodder 5 together with a main spring means provided by helical spring 13 and a prodder spring means provided by a helical spring 14. The main spring 13 is mounted on the lowermost part of the dose chamber 12 and contacts the lowermost part of the plunger 4 to bias against downward movement of the plunger toward the dose chamber 12. The prodder 5 is generally cylindrical and is provided with a portion of its lowest end adjacent a fluid outlet opening 15 defining an at least partially tapered profile to facilitate an ease of engagement and sealing with the fluid outlet opening 15. The prodder spring 14 is connected at one end to the plunger 4 and at its other end to the prodder 5. Coaxial with the prodder 5 is the fluid outlet opening 15 which is shown as a right angled opening but is preferably cylindrical and formed from a material that is at least somewhat flexible and sized to form a convenient interference fit with the tapered portion of the prodder 5.

FIG. 1 shows the start position wherein the plunger 4 is at its uppermost position of travel when closest to a fluid inlet 7 from the container 3, whilst the prodder 5 is also in its uppermost position in which the prodder 5 does not form a seal with the fluid outlet opening 15. Whereas FIG. 2 shows the charging position wherein the plunger 4 and prodder 5 are at their lowest positions and the prodder 5 forms a prodder seal with the fluid outlet opening 15 which prevents any fluid in the dose chamber 12 from entering the fluid outlet opening 15.

The main spring 13 is mounted coaxially with the prodder spring 14 and is sized to surround the prodder spring 14. The main spring 13 is carefully selected to ensure that has an overall spring strength that is weak enough to permit the plunger 4 to travel down the main chamber from a start position to a charging position when the plunger 4 is exposed to the fluid pressure from the container 3, whilst also being strong enough to act with the fluid pressure in the dose chamber 12 to return the moveable plunger 4 back to the start position at the end of a charging cycle, said cycle being described below. Thus the main spring 13 means is provided to provide resistive pushing forces only. The prodder spring 14 is provided of a size and strength such that when the plunger 4 is adjacent to the start position the prodder spring 14 is resistant to any further stretching such that further movement of the plunger 4 toward the start position will cause the prodder spring 14 to pull the prodder 5 away from the fluid outlet opening 15 thus breaking the prodder seal. The prodder spring 14 is provided to provide both resistive pushing and pulling forces depending upon which part of the cycle of movement the movable components are in.

In operation the movable components cycle between the starting position and into the charging position during which a dose of fluid to be sprayed builds up before eventually releasing and spraying said dose whilst substantially simultaneously therewith or substantially immediately thereafter returning to the starting position to repeat the cycle.

The operation cycle will be described in more detail hereinafter. Before the valve assembly is activated the movable components of the assembly 2 are in the starting position. Once the valve assembly 2 is activated, such as by unscrewing a threaded top or the like, fluid flows from the container 3 through the fluid inlet 7 and into the main chamber 8. As the pressure of the fluid bears against the plunger 4 only a very small quantity of the fluid is able to enter the the leak paths provided by hole 10 and score line 10' and, therefore, much like the wind pushes a sail on a yacht with a small hole in it, the remainder of the fluid pushes the plunger 4 downwards against the force of the main spring 13. The downward movement of the plunger 4 causes downward movement of the prodder spring 14 which is mounted on the prodder 5 and cause the downward movement of the prodder 5. Alternatively or additionally, the plunger 4 may directly contact the prodder 5 to effect or assist the downward movement thereof until the prodder 5 makes sealing engagement with the fluid outlet opening 15. Once the prodder seal is made, the movable components are then in the charging position and a dose of fluid begins to build in the dose chamber 12.

Once the prodder seal is made and the charging position arrived at, the dose chamber 12 begins to fill with fluid which initiates the return stroke of the cycle back to the starting position. During the return stroke the dose chamber 12 slowly fills with fluid from the leak path provided by hole 10 and since the fluid cannot escape past the prodder seal, this building volume of fluid causes the plunger 4 to move toward its uppermost position, the main spring 13 assists this upward movement. During the return stroke the prodder 5 remains engaged with the fluid outlet opening 15 until the plunger 4 is immediately adjacent to its uppermost position (i.e. the starting position) wherein the plunger 4 is immediately adjacent to the at least partial groove 17, and specifically a tapered portion 18 of said groove 17, in the main chamber 8 and the fluid is able to escape from the main chamber 8 into the dose chamber 12 via said groove 17 thus very briefly permitting the dose chamber 8 and the leak path provided by score line 10' which is a superimposed score line, to be exposed to the full fluid pressure of the container 3. The momentary exposure to the full container pressure causes all of the movable components of the assembly 2 to be in their uppermost position which is the starting position and the cycle starts again and the fluid pressure acting on the plunger 4 moves the plunger 4, much like wind pushes a sail on a yacht with a small hole in it, downwards away from the groove stopping further fluid using same to enter the dose chamber 12 and allowing the prodder 4 to move downwards into sealing engagement with the fluid outlet opening 15 to re-create the prodder seal and the charging position is arrived at and the dose chamber can again begin to slowly fill with fluid.

Figure 3:
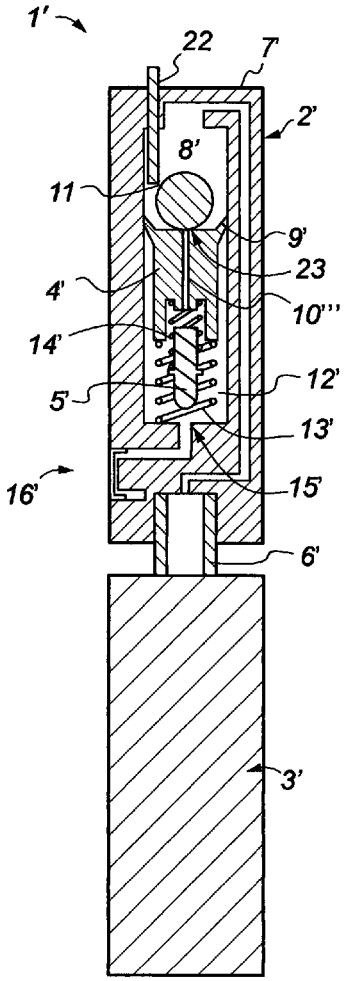
FIG. 3 illustrates a sectioned side view of an apparatus according to aspects 1-3 & 7-9 of the present invention in a start position.
Figure 4:
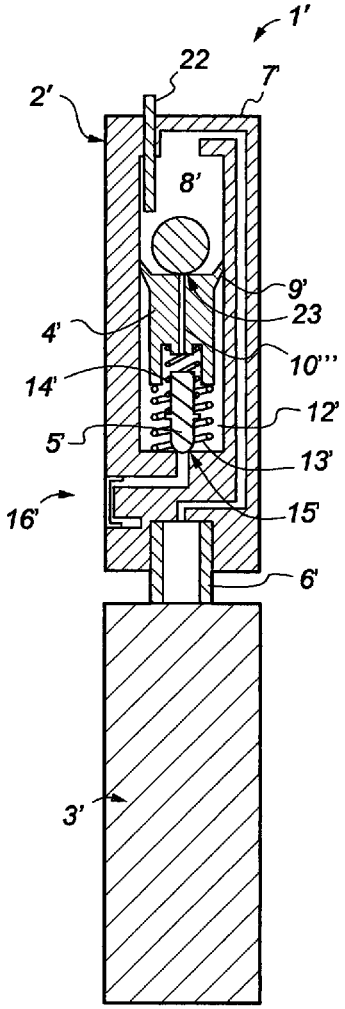
FIG. 4 illustrates a sectioned side view of an apparatus according to aspects 1-3 & 7-9 of the present invention in a charging position.

Referring to both FIGS. 3&4, a non-electrically powered automatic dosing and spraying apparatus 1' is shown which comprises a valve assembly 2' and a container of pressurised fluid 3'. The container of fluid 3' may be a standard aerosol canister with an outlet valve 6', wherein the valve assembly 2' is connected to the container 3' to open the outlet valve 6' to permit the fluid to flow into the valve assembly 2'. The fluid flows through a fluid inlet 7' and into a main chamber 8' where the fluid meets a movable plunger 4' which is sealed via sealing means 9' against the inner walls of the main chamber 8'. Extending from the uppermost part of the main chamber 8' is timer pin 22 in the form of an elongate protrusion, the timer pin 22 is non-centrally located within the main chamber 8'. The plunger 4' is provided with a leak path provided by a centralised hole 10''' that travels the entire length of the plunger 4'. The hole 10''' is covered by a ball 11 which sits in ball seat 23 to almost or partially seal the hole 10 against fluid flow into same.

The leak path provided by hole 10''' leads to dose chamber 12' located directly below the main chamber 8' and is shown here with both chambers 8'&12' having a substantially identical diameter and are formed from a singular chamber which is separated into the main chamber 8 and the dose chamber 12' solely by the contact point of the sealing means 9' against the walls of said singular chamber.

Figure 5:
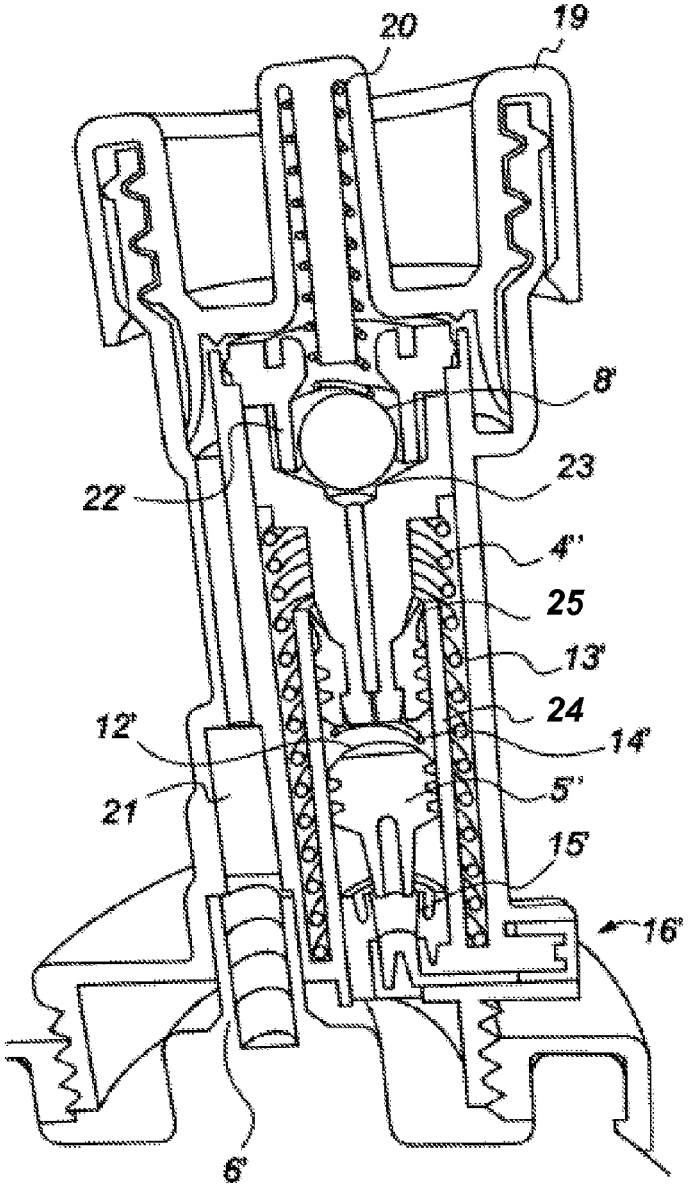
FIG. 5 illustrates a section side view of an alternative apparatus according to aspects 1-3 & 7-9 of the present invention in a start position.

In the dose chamber 12' there is housed a movable prodder 5' together with a main spring means provided by helical spring 13' and a prodder spring means provided by a helical spring 14'. The main spring 13' is mounted on the lowermost part of the dose chamber 12' and contacts the lowermost part of the plunger 4' to bias against downward movement of the plunger toward the dose chamber 12'. The prodder 5' is generally cylindrical and is provided with a portion of its lowest end adjacent a fluid outlet opening 15' defining an at least partially tapered profile to facilitate an ease of engagement and sealing with the fluid outlet opening 15'. The prodder spring 14 is connected at one end to the plunger 4' and at its other end to the prodder 5'. Coaxial with the prodder 5 is the fluid outlet opening 15' which is shown as a right angled opening but is preferably provided as shown in FIG. 5 being cylindrical, formed from a material that is at least somewhat flexible and sized to form a convenient interference fit with the tapered portion of the prodder 5'.

FIG. 3 shows the start position wherein the plunger 4' is at its uppermost position of travel when closest to a fluid inlet 7' from the container 3', whilst the prodder 5' is also in its uppermost position in which the prodder 5' does not form a seal with the fluid outlet opening 15'. Whereas FIG. 4 shows the charging position wherein the plunger 4' and prodder 5' are at their lowest positions and the prodder 5' forms a prodder seal with the fluid outlet opening 15' which prevents any fluid in the dose chamber 12' from entering the fluid outlet opening 15'.

The main spring 13' is mounted coaxially with the prodder spring 14' and is sized to surround the prodder spring 14'. The main spring 13' is carefully selected to ensure that has an overall spring strength that is weak enough to permit the plunger 4' to travel down the main chamber from a start position to a charging position when the plunger 4' is exposed to the fluid pressure from the container 3', whilst also being strong enough to act with the fluid pressure in the dose chamber 12' to return the moveable plunger 4' back to the start position at the end of a charging cycle, said cycle being described below. Thus the main spring 13' means is provided to provide resistive pushing forces only. The prodder spring 14' is provided of a size and strength such that when the plunger 4' is adjacent to the start position the prodder spring 14' is resistant to any further stretching such that further movement of the plunger 4' toward the start position will cause the prodder spring 14' to pull the prodder 5' away from the fluid outlet opening 15' thus breaking the prodder seal. The prodder spring 14' is provided to provide both resistive pushing and pulling forces depending upon which part of the cycle of movement the movable components are in.

In operation the movable components cycle between the starting position and into the charging position during which a dose of fluid to be sprayed builds up before eventually releasing and spraying said dose whilst substantially simultaneously therewith or substantially immediately thereafter returning to the starting position to repeat the cycle.

The operation cycle will be described in more detail hereinafter. Before the valve assembly is activated the movable components of the assembly 2' are in the starting position. Once the valve assembly 2' is activated, such as by unscrewing a threaded top as discussed below in reference to FIG. 5, fluid flows from the container 3' through the fluid inlet 7' and into the main chamber 8'. As the pressure of the fluid bears against the plunger 4' only a very small quantity of the fluid is able to enter the hole 10''' of the leak path via the gap between the ball 11 and the ball seat 23 and, therefore, much like the wind pushes a sail on a yacht with a small hole in it, the remainder of the fluid pushes the plunger 4' downwards against the force of the main spring 13'. The downward movement of the plunger 4' causes downward movement of the prodder spring 14' which is mounted on the prodder 5' and cause the downward movement of the prodder 5. Alternatively or additionally, the plunger 4' may directly contact the prodder 5' to effect or assist the downward movement thereof until the prodder 5' makes sealing engagement with the fluid outlet opening 15'. Once the prodder seal is made, the movable components are then in the charging position, as shown in FIG. 4, and a dose of fluid begins to build in the dose chamber 12'.

Once the prodder seal is made and the charging position arrived at, the dose chamber 12' begins to fill with fluid which initiates the return stroke of the cycle back to the starting position. During the return stroke the dose chamber 12' slowly fills with fluid from the leak path provided by hole 10''' and since the fluid cannot escape past the prodder seal, this building volume of fluid causes the plunger 4' to move toward its uppermost position, the main spring 13' assists this upward movement. During the return stroke the prodder 5' remains engaged with the fluid outlet opening 15' until the plunger 4' is immediately adjacent to its uppermost position (i.e. the starting position) the timer pin 22 makes contact with an off-centre part of the ball 11 and urges the ball 11 out of partial or almost sealing engagement with the ball seat 23 and very briefly permit the dose chamber 12' and/or the hole 10''' to be exposed to the full fluid pressure of the container 3'. The brief exposure to the full container pressure achieves at least two important functions; firstly it provides a final and rapid expansion of the dose chamber 12' which ensures that the prodder seal is broken permitting the fluid in the dose chamber 12' to pass into the fluid outlet opening 15' and be sprayed into the environment surrounding the assembly 2'. Secondly, the brief exposure momentarily exposes the hole 10''' to the full can pressure imparts a self-cleaning function whereby any particulate matter built up in the hole 10''' is swept away into the dose chamber 12' or out the assembly 2' via the fluid outlet opening 15'. The momentary exposure of the hole 10''' and dose chamber 12' to the full container pressure causes all of the movable components of the assembly 2' to be in their uppermost position which is the starting position and the cycle starts again and the fluid pressure acting on the plunger 4' moves the plunger 4', much like wind pushes a sail on a yacht with a small hole in it, downwards which allows the ball 11 to move away from the timer pin 22 and again almost seal or partially seal against the ball seat 23 and allows the prodder 4' to move downwards into sealing engagement with the fluid outlet opening 15' to re-create the prodder seal and the charging position is arrived at and the dose chamber can again begin to slowly fill with fluid.

Figure 6:
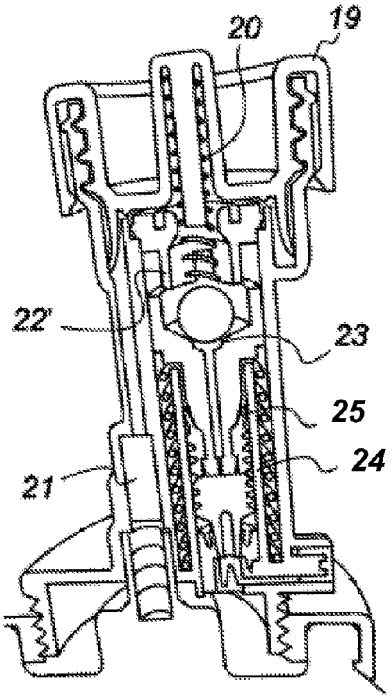
FIG. 6 illustrates a section side view of an alternative apparatus according to aspects 1-3 & 7-9 of the present invention in a charging position.
Figure 7:
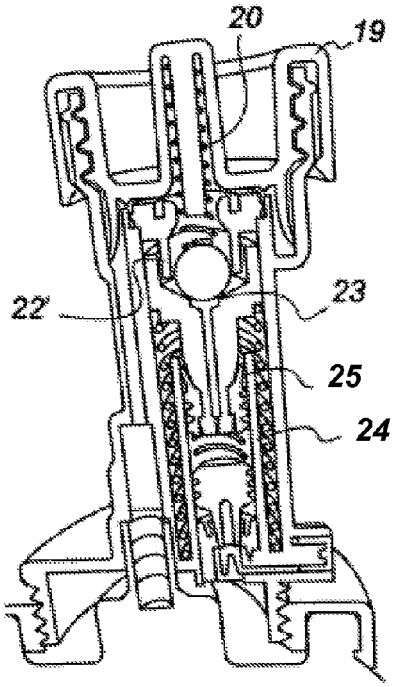
FIG. 7 illustrates a section side view of an alternative apparatus according to aspects 1-3 & 7-9 of the present invention in a charging position.

Turning to FIGS. 5-7 an alternative embodiment is shown wherein the principle differences are that dose chamber walls 24 are provided to reduce the size of the dose chamber and the timer pin 22' is provided by a bulbous protrusion extending from one side of an upper portion of the main chamber 8'. In this embodiment plunger 4" may be provided with at least one of sealing means 9' similar to those in the first embodiment but is preferably or alternatively provided with sealing means 25 between the plunger 4" and the dose chamber walls 24.

The uppermost part of assembly housing may be provided with a movable threaded top 19. The main chamber 8' is defined between the threaded top 19 and the plunger 4". The threaded top 19 may be screwed downwardly until it seals closed the fluid inlet 7'. In this arrangement, a user may activate the apparatus by unscrewing the threaded top 19 to permit fluid in the fluid inlet 7' to pass into the main chamber 8' and initiate the cycle between the starting position and the charging position.

A ball spring means 20 provided by a helical spring is arranged between the ball 11 and the treaded top to assist in ensuring a suitable almost or partial seal between the ball 11 and the valve seat 23 to restrict fluid flow from the main chamber 8 into the hole 10.

The operation cycle as described above is shown in FIGS. 5-7, wherein the starting position is shown in FIG. 5 wherein the prodder 5" is not in sealing engagement with the fluid outlet opening 15', the plunger 4" is in its uppermost position and the bulbous timer pin 22 is in contact with one side of the ball 11 to ease the ball 11 out of almost or partial sealing with the ball seat 23. FIG. 6 shows the when the assembly has first arrived at charging position from the starting position of FIG. 5, here it can be seen that the plunger 4" directly contacts the prodder 5" to urge same into the fluid outlet opening 15' to create the prodder seal. Turning to FIG. 7 the build up of fluid in the dose chamber 12' can be seen just before the ball 11 contacts the timer pin 22 to return the assembly back to the orientation shown in FIG. 5.

A particulate filter 21 is shown, this is present to reduce or prevent the passage of particulate matter into the main chamber and further into the valve assembly thus reducing the likelihood of the device tending toward blockage and/or failure.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A non-electrically powered automatic dosing and spraying apparatus comprising a valve assembly and a container of pressurised fluid with an outlet valve, wherein the valve assembly is connected to the container to open the outlet valve to permit the fluid to flow into the valve assembly and wherein the valve assembly comprises a housing containing at least two chambers wherein one of those chambers is a main chamber open at one end to the contents of the container and closed at one end by a movable plunger, and another of those chambers is a dose chamber closed at one end by the movable plunger and closed at the other end by a prodder seal formed between a movable prodder and a fluid outlet opening; wherein the movable plunger is biased against movement toward the dose chamber by a main spring means and a prodder spring means being connected to both the moveable plunger and the movable prodder; the assembly further comprises a fluid leak path between the main chamber and the dose chamber; and wherein the assembly is arranged such that, in use, the dose chamber with gradually fill with fluid and one movable component of the assembly is configured to move relative to another component of the assembly to provide a final and rapid expansion of the dose chamber, releasing and spraying a dose of fluid whilst substantially simultaneously therewith or substantially immediately thereafter returning to the start position to repeat the cycle.

2. The apparatus according to claim 1, wherein at least one of the main chamber and/or dose chamber is provided with one or more at least partial grooves therein arranged to be located adjacent said plunger sealing means when the plunger is at or adjacent to its uppermost position remote from the fluid outlet opening.

3. The apparatus according to claim 2, wherein the at least partial groove extend circumferentially and/or vertically.

4. The apparatus according to claim 1, wherein the main spring means is provided with a spring strength that is weak enough to permit the moveable plunger to travel from a starting position to a charging position when exposed, in use, to the fluid pressure from the container, whilst also being strong enough to act with resultant fluid pressure in the dose chamber to return the moveable plunger back to the start position.

5. The apparatus according to claim 4, wherein it takes of the order of 5 to 20 minutes for the plunger and the prodder to move from the starting position through the charging position and back to the starting position.

6. The apparatus according to claim 1, wherein the prodder spring means is provided of a size and strength such that when the moveable plunger is adjacent to the starting position the prodder spring means is resistant, in use, to any further stretching such that further movement of the plunger toward the starting position will cause the prodder spring to pull the prodder away from the fluid outlet opening to break the prodder seal.

7. The apparatus according to claim 1, wherein the prodder spring means is provided in the valve assembly to provide both resistive pushing and pulling forces depending upon which part of the cycle of movement the movable components are in.

8. The apparatus according to claim 1, wherein the movable plunger is sized to move within the main chamber and is provided with sealing means to prevent free movement of fluid between the main chamber and the dose chamber.

9. The apparatus according to claim 1, wherein the movable prodder is sized to move within the dose chamber and is provided with a portion of its lowest end adjacent the fluid outlet opening defining an at least partially tapered cylinder profile.

10. The apparatus according to claim 1, wherein the fluid outlet opening is cylindrical and sized to form a convenient interference fit with the prodder.

11. The apparatus according to claim 1, wherein the fluid leak path is sized to facilitate a rate of fluid transfer between the chambers that is slower than a rate of fluid transfer from the container to the main chamber.

12. The apparatus according to claim 1, wherein a fluid inlet from the container into the main chamber of the assembly is at a substantially uppermost part of the main chamber and the fluid leak path to the dose chamber is at a substantially lowermost part of the main chamber, and the fluid leak path is located at the substantially uppermost part of the dose chamber and the fluid outlet opening is at the substantially lowest part of the dose chamber.

13. The apparatus according to claim 1, wherein the main chamber and the dose chamber are substantially cylindrical and are provided with substantially similar diameters, with the main chamber positioned directly above the dose chamber.

14. The apparatus according to claim 1, wherein the dose chamber is provided with a reduced diameter relative to the diameter of the main chamber.

15. The apparatus according to claim 14, wherein the main chamber is located above and at least partially surrounding the dose chamber wherein dose chamber walls are provided within the main chamber.

16. The apparatus according to claim 1, wherein an uppermost part of the main chamber is closeable by a moveable threaded top which can be screwed down to close or at least partially close fluid flow into the main chamber and/or to restrict movement of the plunger.

17. The apparatus according to claim 16, wherein there is a spring between the moveable threaded top and the plunger.

18. The apparatus according to claim 1, wherein, in use, the movable components in the valve assembly cycle movement between a starting position and a charging position, and in the starting position the movable plunger is at an uppermost position of travel when closest to a fluid inlet from the container, whilst the moveable prodder is also in its uppermost position in which the prodder does not form a seal with the fluid outlet opening, and wherein in the charging position the movable plunger and the movable prodder are located in their lowest positions such that the prodder creates the fluid-tight prodder seal with the fluid outlet opening.

19. The apparatus according to claim 1, wherein the fluid leak path is provided by a substantially centralised hole in the plunger and is provided with a restriction means in the main chamber which almost seals or partially seals the fluid leak path entrance to reduce the rate of fluid transfer between the chambers.

20. A method of using the apparatus of claim 1, wherein the method comprises deactivating the valve assembly to arrest the movement of the movable components and thus cease further spraying of fluid.

* * * * *